United States Patent [19]

Aoki

[11] 4,188,922

[45] Feb. 19, 1980

[54] DIGITAL CONTROL DEVICE FOR A FUEL INJECTION SYSTEM OF AN INTERNAL COMBUSTION ENGINE

[75] Inventor: Keiji Aoki, Susono, Japan

[73] Assignee: Toyota Jidosha Kogyo Kabushiki Kaisha, Toyota, Japan

[21] Appl. No.: 846,359

[22] Filed: Oct. 28, 1977

[30] Foreign Application Priority Data

Nov. 16, 1976 [JP] Japan ..... 51/136937

[51] Int. Cl.[2] ..... F02B 3/00

[52] U.S. Cl. ..... 123/32 EA; 123/32 EB

[58] Field of Search ..... 123/32 EA, 32 EB; 364/442; 73/119 A

[56] References Cited

U.S. PATENT DOCUMENTS

| | | | |
|---|---|---|---|
| 3,898,962 | 8/1975 | Honig | 123/32 EB |
| 3,986,006 | 10/1976 | Kawai | 123/32 EB |
| 3,991,727 | 11/1976 | Kawai | 123/32 EA |
| 4,048,965 | 9/1977 | Biachi | 123/32 EA |
| 4,050,878 | 9/1977 | Priegel | 123/32 EA |

*Primary Examiner*—Bernard Konick
*Assistant Examiner*—Alan Faber
*Attorney, Agent, or Firm*—Stevens, Davis, Miller & Mosher

[57] ABSTRACT

Disclosed is a digital control device for controlling at least one of the solenoids of the fuel injection valves associated with an internal combustion engine in accordance with both the amount of air introduced into the engine and the number of revolutions of the engine. The digital control device comprises two pulse generating means, a switching element, a binary counter, and a digital computer. A pulse signal provided from a pulse generating means and exhibiting a pulse width which is inversely proportional to the number of revolutions of the engine, causes the switching element to close. Pulse signals provided from other pulse generating means, each signal having a frequency which is proportional to the amount of air introduced into the engine, pass through the switching element during the conducting period of the switching element. The number of the passing pulse signals is thereby counted by the binary counter. The digital signal provided from the binary counter is applied to the digital computer so as to perform arithmetic functions for controlling the solenoids of the fuel injection valves.

7 Claims, 4 Drawing Figures

DIGITAL CONTROL DEVICE FOR A FUEL INJECTION SYSTEM OF AN INTERNAL COMBUSTION ENGINE

BACKGROUND OF THE INVENTION

The invention relates to a digital control device for a fuel injection system of an internal combustion engine, and particularly, to a device for controlling at least one of solenoids of the fuel injection valves in accordance with the rate of air flow which is introduced into the engine and with the signal which is proportional to the number of revolutions of the engine.

Recently, much attention has been focused upon the construction of a control device which can accurately control the air-fuel ratio of an internal combustion engine in order to solve some problems caused by recent strict exhaust emission controls, for instance, controls for promoting fuel economy. Accordingly, many such precise control devices are now available. These devices generally comprise a digital microcomputer used for controlling the amount of fuel injected into the engine so that the controlled amount of fuel corresponds to the amount of air which is introduced into the engine. In a conventional fuel injection system, the injection valves are operated intermittently and are opened for a specific injection period at each stroke of the corresponding cylinder of the engine. Accordingly, the amount q of fuel which is provided to the engine during a specific period of time is expressed as:

$$q=N\cdot T\cdot k \quad (1)$$

where N is the number of revolutions (rpm) of the engine, T is the injection period of the injection valves, and k is a unit amount of fuel injection. The unit amount k depends upon the injection pressure of the injection valve and upon the cross-sectional area of the opening of the injection valve. The air-fuel ratio (A/F) of the internal combustion engine is then defined as:

$$A/F=Q/q=Q/(N\cdot T\cdot k) \quad (2)$$

where Q is the amount of air provided to the engine during a specific period of time. In the above equation (2), the amount of air (Q) introduced into the engine and the number of revolutions of the engine (N) can be respectively measured by means of measuring devices attached to the engine. Therefore, the optimum combustion of the air/fuel mixture can be obtained by controlling the injection period T, which is calculated by the digital computer in accordance with operating parameters of the engine such as the amount of air introduced into the engine or the number of revolutions of the engine, so that the injection period T is proportional to Q/N. However, the control devices employing a digital computer according to the prior art require analogue-digital converters for converting input signals which represent the respective operating parameters of the engine. These analogue-digital converters, particularly those converters for converting an input signal which represents the amount of air introduced into the engine, are extremely expensive to construct. Therefore, it is generally very difficult to reduce the total costs of the conventional control devices employing analogue-digital converters.

Further, in the prior control devices because the calculation of Q/N is performed by a digital computer, a time delay corresponding to the operation time of the computer always occurs in the controlling of the engine.

Another disadvantage of the prior control devices is that the calculation of Q/N which is performed by the digital computer causes the capacity of the arithmetic circuits in the digital computer to be increased.

BRIEF SUMMARY OF INVENTION

It is therefore an object of the present invention to provide a low cost digital control device for a fuel injection system.

Another object of the invention is to provide a digital control device for a fuel injection system, in which the digital computer is not required to execute the calculation Q/N.

According to the present invention, the digital control device for the fuel injection system comprises a first pulse generating means having an output frequency which is proportional to the number of revolutions of the connected internal combustion engine and a bistable circuit which is connected to the first pulse generating means and triggered by the pulse signals provided from the first pulse generating means. The digital control device further comprises a first switching element and a second pulse generating means having an output frequency which is proportional to the amount of air introduced into the engine. The first switching element has a first input terminal which is connected to the second pulse generating means and a second input terminal which is connected to the output terminal of the bistable circuit. The first switching element is actuated by pulse signals which are provided from the bistable circuit. The digital control device further comprises a digital computer and a binary counter connected to the first switching element for counting the number of pulse signals passing through the first switching element during one operation period thereof. The digital computer has an input terminal for receiving output digital signals provided from the binary counter and an output terminal connected to the solenoids of the respective fuel injection valves of the engine for electrically controlling the fuel injection valves. The digital computer comprises an arithmetic unit for multiplying the value of an input, which is responsive to the counted digital signal, with a bit of information corresponding to the operating characteristics of the engine and further comprises a storage unit for storing the information.

In the preferred embodiment, the first pulse generating means comprises a distributor which provides ignition signals of the engine and a pulse shaper connected to an output terminal of the distributor for forming pulse wave-forms of the output signals in accordance with the ignition signals.

Further, the second pulse generating means comprises an airflow meter mounted in the induction pipe of the engine and a pulse generator connected to an output terminal of the airflow meter and providing pulse signals having a frequency which is proportional to the amount of air passing through the airflow meter.

The digital control device, in a further preferred embodiment, comprises a second switching element and a monostable circuit. The second switching element is inserted between the output terminal of the binary counter and the input terminal of the digital computer for transferring binary output signals of the binary counter to the digital computer in accordance with a control signal which is provided from the monostable circuit. The monostable circuit has an input terminal connected to the output terminal of the bistable circuit and an output terminal connected to a second input terminal of the second switching element. The monostable circuit is triggered by the trailing edge of each of the pulse signals provided from the bistable circuit.

The above and other related objects and features of the present invention will be apparent from the following description of the disclosure with reference to the accompanying drawings and from the appended claims which disclose the novelty of the invention.

DETAILED DESCRIPTION

Figure 1:
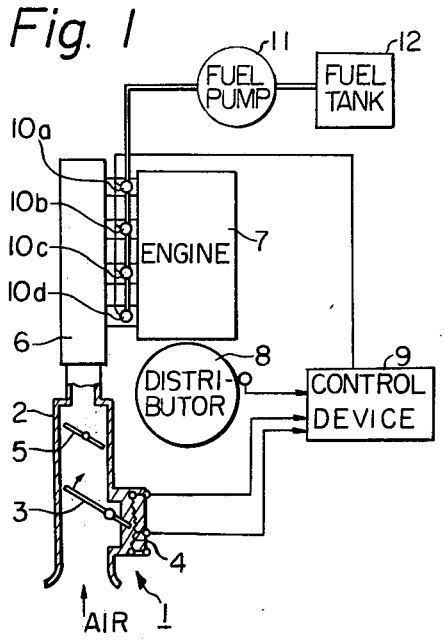
FIG. 1 is a schematic illustration of a control device for a fuel injection system in accordance with the present invention.

Referring to the attached drawings, in FIG. 1, an internal combustion engine 7 draws air by way of an induction pipe 2 and a surge tank 6. A butterfly valve 3 which can be rotated by the introduced air is mounted in the induction pipe 2. A variable resistor 4 whose output resistance is inversely proportional to the angular position of the butterfly valve 3, is also arranged on the induction pipe 2. The butterfly valve 3 and the variable resistor 4 together constitute an airflow meter 1. A throttle valve 5 also arranged in the induction pipe 2 can operate an accelerator pedal (not shown in the Figures).

Fuel provided from a fuel tank 12 by a fuel pump 11 can be injected into intake ports which connect the surge tank 6 to each of the cylinders of the engine 7 by means of injection valves 10*a*, 10*b*, 10*c* and 10*d*.

A crankshaft or a camshaft (not shown) of the internal combustion engine 7 is utilized to drive a distributor 8.

A control device 9 including a digital microcomputer is electrically connected to the airflow meter 1, the distributor 8, and the solenoids of the injection valves 10*a*, 10*b*, 10*c* and 10*d*.

Figure 2:
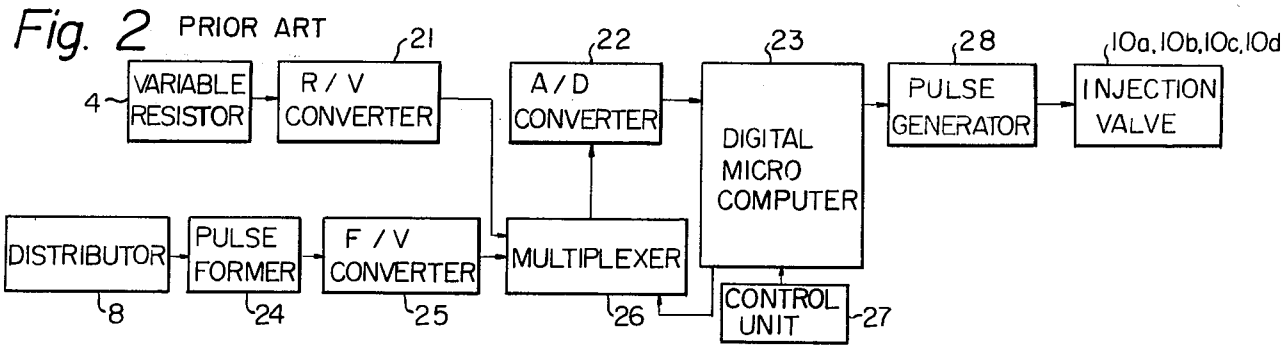
Fig. 2 PRIOR ART
FIG. 2 is a block diagram of a control device for a fuel injection system according to the prior art.

FIG. 2 shows a block diagram of the control device for a fuel injection system according to the prior art. In this control device, the output terminal of the variable resistor 4 shown in FIG. 1 is connected to the first input terminal of a multiplexer 26 through a resistance-voltage converter (R/V converter) 21 which converts the output resistance value of the variable resistor 4 into an analogue voltage. The output terminal of the distributor 8 shown in FIG. 1 is connected, through a pulse shaper 24, to the input terminal of a frequency-voltage converter (F/V converter) 25 which converts an input frequency into an analogue voltage. The pulse shaper 24 shapes the wave-form of the ignition signals provided from the distributor 8, into a pulse wave-form. The output terminal of the F/V converter 25 is connected to the second input terminal of the multiplexer 26. The output terminal of the multiplexer 26 is in turn connected to the input terminal of a digital microcomputer 23 through an analogue-digital converter (A/D converter) 22. In response to the control signal which is applied to the multiplexer 26 through the third input terminal from the digital microcomputer 23, the multiplexer 26 can provide either output signals from the R/V converter 21 or output signals from the F/V converter 25 to the input terminal of the A/D converter 22. A control unit 27, which provides command signals for initiating calculations by the computer 23, is connected to the control input terminal of the computer 23. If the computer 23 is to function as a microprocessor, the control unit 27 should include an interrupt processing unit and a storing unit. The input terminal of a pulse generator 28 is connected to the output terminal of the digital microcomputer 23 for producing pulse signals exhibiting pulse widths which are proportional to the values of the binary output signals provided from the computer 23. The output terminal of the pulse generator 28 is electrically connected to the injection valves 10*a*, 10*b*, 10*c* and 10*d*.

The resistance value of the variable resistor 4 in the airflow meter 1, which value corresponds to the amount of air introduced into the engine, is converted to an analogue voltage by means of the R/V converter 21. On the other hand, the ignition signals provided from the distributor 8 are applied to the F/V converter 25 through the pulse shaper 24. The frequency of the ignition signals is proportional to the number of revolutions of the engine; therefore, the value of the output voltage provided from the F/V converter 25 is proportional to the number of revolutions of the engine. Either output signals from the R/V converter 21 or output signals from the F/V converter 25 are alternately applied to the A/D converter 22 in accordance with the operation of the multiplexer 26 which is controlled by control signals provided from the digital microcomputer 23. Accordingly, digitized signals which represent the amount of air introduced into the engine and the number of revolutions of the engine are applied to the digital computer 23 and stored in the storing unit (not shown) of the computer 23. Then the calculation of k(Q/N) is executed in the computer 23 in accordance with the aforementioned command signals. The thus calculated binary output signals from the computer 23 are thereafter fed into the pulse generator 28. In the pulse generator 28, the input binary signals are converted to pulse signals exhibiting pulse widths which are proportional to the value of the input binary signals. The output pulse signals of the pulse generator 28 are fed to the solenoids of the injection valves 10*a*, 10*b*, 10*c* and 10*d*. The thus fed signals serve to control the intermittent operation of the fuel injection valves.

Figure 3:
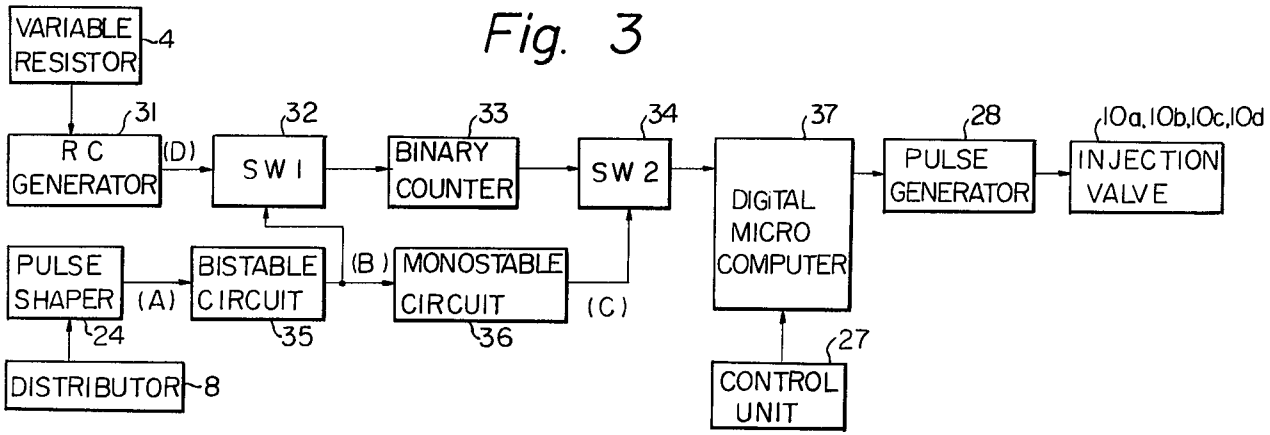
FIG. 3 is a block diagram of a control device for a fuel injection system showing a preferred embodiment of the present invention.

FIG. 3 shows an embodiment of a digital control device for a fuel injection system in accordance with the present invention. The variable resistor 4 of this digital control device is the same as the variable resistor 4 which is shown in FIG. 1. This resistor 4 provides a resistance value which is proportional to the amount of air introduced into the engine (shown in FIG. 1), in cooperation with the butterfly valve 3 (shown in FIG. 1) of the airflow meter 1. An output terminal of the variable resistor 4 is connected to the resistance terminals in an RC generator 31 so that the variable resistor 4 is included in a feedback circuit which determines the output frequency of the RC generator 31. The output terminal of the RC generator 31 is connected to the input terminal of a binary counter 33 through a first switching element 32 (SW1), such as an AND gate. The output of the binary counter 33 is connected to the input terminal of a digital microcomputer 37 through a second switching element 34 (SW2), such as an AND gate.

The output terminal of the distributor 8 shown in FIG. 1 is connected to the input terminal of a bistable circuit 35, such as a flip-flop circuit through the aforementioned pulse shaper 24. The output of the bistable circuit 35 is connected to both the input terminal of a monostable circuit 36, such as a monostable multivibrator, and to the control terminal of the first switching element 32. The output terminal of the monostable circuit 36 is connected to the control terminal of the second switching element 34. The switching elements 34 as well as the switching elements 32 are closed when a high level signal is being applied to the control terminal thereof. The digital microcomputer 37 has an arithmetic unit used for the multiplication operation and a storage unit in which the information corresponding to the operating characteristics of the engine, for example, the unit amount of injected fuel k, is stored. The input terminal of the arithmetic unit is responsive to the input digital signal of the digital microcomputer 37. The control unit 27, the pulse generator 28, and the injection valves 10*a*, 10*b*, 10*c* and 10*d* are respectively the same in construction as those of the prior art shown in FIG. 2.

In the feedback circuit of the RC generator 31, the capacitance value of the capacitor is a constant value; therefore, the output pulse frequency of the RC generator 31 is inversely proportional to the resistance value of the variable resistor 4. The variable resistor 4 is connected in such a way that the resistance value thereof is decreased in accordance with the increasing amount of air introduced into the engine. Accordingly, the frequency of the output pulses of the generator 31 is proportional to the amount of air introduced into the engine.

Figure 4:
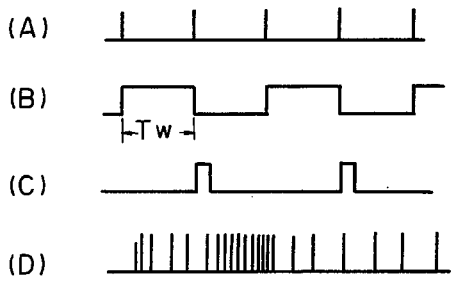
FIG. 4 shows wave-form charts for explaining the operation of the embodiment shown in FIG. 3.

In FIG. 4, (A) shows the wave-form of an output signal produced by the pulse shaper 24, (B) shows the wave-form of an output signal produced by the bistable circuit 35, (C) shows the wave-form of an output signal produced by the monostable circuit 36, and (D) shows the wave-form of an output signal produced by the RC generator 31.

The operation of the digital control device according to the present invention will now be explained with reference to FIG. 3 and FIG. 4.

The pulse signals produced by the RC generator 31 exhibit a frequency which depends on the resistance value of the variable resistor 4 in the airflow meter 1. As mentioned above, the resistance value corresponds to the amount of air introduced into the internal combustion engine. Therefore, the frequency $f_1$ of the output pulse signal (D) of the RC generator 31 is proportional to the amount Q of air introduced into the engine.

On the other hand, the ignition signals provided from the distributor 8 are applied to the input terminal of the bistable circuit 35 through the pulse shaper 24. The frequency of the ignition signals is the same as the frequency $f_2$ of the output pulse signal (A) of the pulse shaper 24; therefore, the frequency $f_2$ is proportional to the number of revolutions N of the internal combustion engine. Accordingly, the pulse width Tw of the output pulse signal (B) of the bistable circuit 35 is inversely proportional to the number of revolutions N (rpm) of the engine. In the case of a four-cycle engine, this pulse width Tw is expressed as:

$$Tw = 120/(M \cdot N) \text{ sec} \quad (3)$$

where M is the number of cylinders of the engine.

The output pulse signals (B) of the bistable circuit 35 are applied to the control terminal of the first switching element 32. Thus, during the period which is equivalent to the pulse width Tw, the first switching element 32 is closed by the output pulse signals (B); thereby, during this period, the output pulse signals (D) of the RC generator 31 are transferred to the binary counter 33. The binary counter 33 counts the number of the input pulse signals (D) which is supplied from the RC generator 31 during the period the first switching element 32 is closed. The frequency of the pulse signals (D) which will be counted by the binary counter 33 is expressed as $f_1$, and the operating period of the binary counter 33 for counting is expressed as Tw. Therefore, the number S being counted by the binary counter 33 is expressed as $S = f_1 \cdot Tw$. As has already been described above, the frequency $f_1$ is proportional to the amount of air Q introduced into the engine; while the pulse width Tw is inversely proportional to the number of revolutions N of the engine, so that the counted number S is proportional to the quotient Q/N.

The output pulse signals (B) of the bistable circuit 35 are also applied to the input terminal of the monostable circuit 36. As a result, the monostable circuit 36 is triggered by the trailing edge each of the pulse signals (B), and then the circuit 36 supplies pulse signals (C) having a certain pulse width to the control terminal of the second switching element 34. Thus, during the period which corresponds to the pulse width of the pulse signal (C), the second switching element 34 closes and transfers the binary output signals of the binary counter 33, which signals are represented by the counted number S, to the input terminal of the digital microcomputer 37.

The digital microcomputer 37 multiplies the value of the input signal which is provided from the binary counter 33 and which represents the quotient Q/N multiplied by the constant k. The value of the constant k is stored in the storage unit of the computer 37 and represents a unit amount of the injected fuel in accordance with the command signals transmitted from the control unit 27. The binary output signal of the thus multiplied value which is transmitted from the digital microcomputer 37 is next fed into the solenoids of the fuel injection valves 10*a*, 10*b*, 10*c* and 10*d* through the pulse generator 28. Consequently, the fuel injection valves 10*a*, 10*b*, 10*c* and 10*d*, as well as those of the aforementioned prior art, are controlled in such a way that an optimum combustion of the air/fuel mixture is obtained.

In the digital control device according to the present invention, since the input signals of the digital microcomputer are represented by the quotient Q/N, it is not necessary to perform a division operation of Q/N in the digital microcomputer. Therefore, the processing time for the division operation, which generally takes a long time, can be eliminated, thus reducing the overall processing time. Furthermore, the capacity of the arithmetic circuits of the digital microcomputer can be advantageously reduced. That is, an advantage of the digital control device according to the present invention is that an excellent time response can be obtained because the time delay which occurs during the calculation of k·(Q/N) can be considerably reduced. A further advantage of the present invention is that the device according to the invention can be provided at an extremely low cost because no A/D converter is required in this device.

It is understood that various changes and modifications of the airflow meter may be made in accordance with the present invention. For example, the airflow meter may consist of a rotating turbine mounted in the induction pipe of the engine and of a pulse generator producing pulse signals having a frequency which is proportional to the number of revolutions of the rotating turbine.

As many widely different embodiments of the present invention may be made without departing from the spirit and scope of the present invention, it should be understood that the invention is not limited to the specific embodiment described in the specification except as defined in the appended claims.

What is claimed is:

1. A digital control device of an internal combustion engine for controlling at least one solenoid of the fuel injection valves in accordance with the amount of air introduced into said engine and with the rotational speed of said engine, said digital control device comprising:

a first pulse generating means for generating pulse signals having a frequency which is proportional to the rotational speed of said engine, said first pulse generating means having an output terminal;

a bistable circuit connected to the output terminal of said first pulse generating means and triggered by said pulse signals provided from said first pulse generating means, said bistable circuit having an output terminal;

a second pulse generating means for generating pulse signals having a frequency which is proportional to the amount of air introduced into said engine, said second pulse generating means having an output terminal and directly converting the resistance value corresponding to the amount of air introduced into the engine into the frequency value of the pulse signals, said second pulse generating means comprising a variable resistor and a pulse generator comprising an RC generator having a feed back circuit to which the variable resistor is connected;

a first switching element having a first input terminal connected to the output terminal of said second pulse generating means and having a second input terminal connected to the output terminal of said bistable circuit, said first switching element being actuated by pulse signals provided from said bistable circuit and having an output terminal;

a binary counter having an input terminal connected to the output terminal of said first switching element for counting the number of pulse signals passing through said first switching element during one operation period of said first switching element, said binary counter having an output terminal;

a second switching element having a first input terminal connected to the output terminal of the binary counter for receiving binary output signals therefrom, a second input terminal, and an output terminal;

a monostable circuit having an input terminal which is also connected to the output terminal of the bistable circuit and an output terminal which is connected to the second input terminal of the second switching element, said monostable circuit being triggered by the trailing edge of each of the pulse signals from the bistable circuit and supplying pulse signals of a certain duration to the second input terminal of the second switching element to close it during those times; and a digital computer comprising an input terminal connected to the output terminal of the second switching element for receiving the binary output signals of said binary counter, an output terminal for providing control signals so as to control at least one of said solenoids of said fuel injection valves, an arithmetic unit for multiplying the values of input signals which are responsive to said output signals of said binary counter with information corresponding to the operating characteristics of said engine, and a storage unit for storing said information.

2. A digital control device as claimed in claim 1, wherein said first pulse generating means comprises a distributor which is arranged in said engine and which provides ignition signals of said engine and a pulse shaper having an input terminal connected to an output terminal of said distributor for forming pulse wave forms of output signals in accordance with said ignition signals.

3. A digital control device as claimed in claim 1, for a fuel injection system of an internal combustion engine having an induction pipe, wherein said second pulse generating means comprises an airflow meter mounted in said induction pipe of said engine and said pulse generator is connected to an output terminal of said airflow meter for providing pulse signals exhibiting a frequency which is proportional to the amount of air passing through said airflow meter.

4. A digital control device as claimed in claim 3, wherein said airflow meter comprises a butterfly valve arranged in said induction pipe of said engine and the resistance of said variable resistor is inversely proportional to the angular change of said butterfly valve.

5. A digital control device as claimed in claim 1, wherein said monostable circuit consists of a monostable multivibrator.

6. A digital control device as claimed in claim 1, wherein said bistable circuit consists of a flip-flop circuit.

7. A digital control device as claimed in claim 1, further comprising a pulse generator inserted between the output terminal of said digital computer and each of said solenoids of said fuel injection valves for providing pulse signals whose pulse width represents the time of the injection period of said fuel injection valves according to digital signals provided from said digital computer.

* * * * *